US006209748B1

(12) United States Patent
Dunbar

(10) Patent No.: US 6,209,748 B1
(45) **Date of Patent: *Apr. 3, 2001**

(54) CONDIMENT-CARRYING LID

(76) Inventor: Lee Wayne Dunbar, 323 Meadow Ct., Vernon Hills, IL (US) 60061

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/244,999

(22) Filed: Feb. 4, 1999

(51) Int. Cl.[7] ..... B65D 1/24

(52) U.S. Cl. ..... 220/521; 220/23.86; 220/380; 220/521; 220/212; 220/712; 220/735; 220/713

(58) Field of Search ..... 220/23.83, 23.86, 220/380, 521, 555, 556, 212, 711, 712, 713, 717, 735

(56) References Cited

U.S. PATENT DOCUMENTS

| | | | | |
|---|---|---|---|---|
| D. 296,874 | * | 7/1988 | Dallas | 215/229 X |
| 2,276,678 | * | 3/1942 | Wheeler | 220/521 X |
| 3,598,271 | * | 8/1971 | Holley | 215/41 |
| 4,627,537 | * | 12/1986 | Rogers | 220/712 X |
| 5,180,079 | * | 1/1993 | Jeng | 220/705 |
| 5,657,898 | * | 8/1997 | Portman et al. | 220/712 |
| 5,722,558 | * | 3/1998 | Thompson | 220/521 |
| 5,894,952 | * | 4/1999 | Mendenhall et al. | 220/713 |
| 5,911,331 | * | 6/1999 | Boller | 220/254 |

* cited by examiner

*Primary Examiner*—Stephen K. Cronin
(74) *Attorney, Agent, or Firm*—Cherskov & Flaynik

(57) ABSTRACT

A device for positioning a plurality of objects on a cup is provided comprising a lid having a top surface wherein the lid is adapted to be removably attached to the cup and a region integrally molded with the top surface so as to removably confine the objects to the lid.

7 Claims, 5 Drawing Sheets

CONDIMENT-CARRYING LID

BACKGROUND OF THE INVENTION

1. Field of the Invention

This invention relates to a device for juxtaposing a plurality of objects to a cup or other food or beverage container and more specifically to a device for attaching a coffee stirrer and condiments to a lid adapted to be removably attached to a disposable cup or other food or beverage container.

2. Background of the Invention

Present lifestyles stress speed, mobility, and flexibility. More and more meals are consumed on the run, in the car, on the train. These meals are purchased at fast food outlets by customers in a hurry who demand customized service but who also require that their purchases be packaged in a manner that will facilitate convenient consumption. Correspondingly, the fast-food industry demands more efficient and streamlined methods of providing service to their customers in a cost effective manner.

A typical purchase from a fast-food establishment is the morning cup of coffee or similar beverage on a carry-out basis. Generally, a hot beverage is served in an insulated and/or disposable cup that is sealed with a removable and disposable plastic lid that maintains the temperature of the beverage and prevents spillage. The lid is usually snapped over the rim of the cup. To consume the beverage, one either removes the lid, or, in many circumstances, pries off a portion of the lid that is especially designed to be so detached.

An example of such a disposable lid is reissued U.S. Pat. No. RE31650 to Serritella entitled NON-SPILLABLE CUP LID. Serritella discloses a disposable lid for a coffee cup having penetrable score lines around the sides of a 90° sectorial portion to form an opening providing drinking access. The remainder of the lid provides protection against spillage of the contents of the cup.

A similar example is disclosed by Freemyer (U.S. Pat. No. 3,868,043) and entitled NO-SPILL HOT CUP LID. Freemyer discloses a lid with a perforated drinking section along one edge. The top of the lid slopes towards the drinking section thus providing a funnel for inserting additives in the beverage.

U.S. Pat. No. 5,409,131 to Phillips entitled COFFEE LID teaches a disposable coffee cup lid having an open top comprising a dome shaped cover with an air vent hole that conforms to the coffee cup. A flexible drinking spout for drinking access is formed in the cover and has a shielding structure capable of opening an air vent during use of the spout and sealing the air vent in periods of nonuse.

While all of the above-mentioned lids are capable of preventing spillage, they have common disadvantages. For example, several hand movements are needed to acquire both the filled and sealed cup and any condiments (cream, sugar, etc.) desired. Often, an additional bag containing a stirrer and the condiments is provided. However, this practice wastes paper and entails appreciable environmental and financial costs. It is also time consuming, which is a serious drawback especially during peak business hours. Finally, digging through a condiment bag, which may also contain other items, is frustrating to customers who later learn that not all desired condiments have been included during sometimes rushed exchanges.

Efforts have been made to combine condiment and beverage distribution at the retail level. U.S. Pat. No. 5,431,276 to Lialin, entitled MULTI FUNCTIONAL LID comprises an attachable lid having several sealed independent compartments filled with additives. In operation, when pressure is applied to the top of a compartment, a plunger contained therein punctures the bottom of the compartment and releases the additives into the beverage contained in the cup. The condiments are pre-inserted during lid fabrication.

Certain additional costs are associated with this configuration. For example, depending on the pre-inserted condiments, the lids must be shipped and stored in refrigerated containers. Also, this configuration provides the retailer with no flexibility in selecting only those condiments desired by the customer, yet the retailer must pay for the inclusion of all pre-inserted condiments. Furthermore, the customer has no choice in the amount or types of condiments. Additional or substitute condiments must be supplied in a separate paper bag, hence revisiting the problems outlined supra.

A need exists in the art for a device which combines lid, condiments, and stirrer in an environment-friendly manner. The device should promote cost savings and customized service, particularly during the rush hour. The device should not only eliminate the need for an additional bag, but also facilitate faster and customized service.

SUMMARY OF THE INVENTION

It is an object of the present invention to provide a device for the simultaneous delivery of a beverage and assorted condiments that overcomes the disadvantages of the prior art.

Another object of the present invention is to provide a multi functional, cost-effective condiment lid. A feature of the present invention is that it contains compartments for removably positioning utensils and condiments on the outside of a beverage-confining container. An advantage of the invention is that no additional bag or hand movements or other labor is required to facilitate simultaneous transfer of the beverage and condiments. Another advantage is that the invention provides consumers with a rapid view of the utensils and additives simultaneously tendered with the subject beverage or food.

Still another object of the present invention is to provide an environmentally sound disposable condiment lid. A feature of the invention is that it positions utensils, and various shaped additives onto a single substrate attached to the food container. An advantage of the invention is that the combined unit reduces material waste.

A further object of the present invention is to provide a disposable condiment lid that can improve customer service during peak business times. A feature of the invention is that the lids hold condiments and stirrer firmly enough in place so that the lids loaded with their contents can be easily manipulated. An advantage of the invention is that the stirrer and condiments can be placed on each lid in anticipation of peak business hours.

Briefly, the present invention provides a device for juxtaposing a plurality of objects to a container having a rim, said device comprising a generally planar substrate having a top surface and a bottom surface, said substrate adapted to be removably attached to the rim; and a region integrally molded with said top surface, to removably confine the objects to said substrate.

Also provided is a lid for a beverage cup comprising a first region adapted to support liquid condiment containers, a second region adapted to support non-liquid condiment containers, and a third region adapted to support an utensil.

BRIEF DESCRIPTION OF THE DRAWING

The present invention together with the above and other objects and advantages may best be understood from the following detailed description of the embodiments of the invention illustrated in the drawing, wherein.

DETAILED DESCRIPTION

The present invention provides a device for removably positioning a plurality of objects on the outside surface of a food or beverage container. Specifically, the invention provides a means for removably attaching utensils and condiments to a lid which is adapted to be removably attached to the rim of a beverage container such as a coffee cup.

For the sake of brevity, the following description will focus on lids for disposable cups which are typically dispensed at fast food establishments. However, the disclosed invention is applicable to lids or covers accommodating non-disposable containers, including but not limited to cups, pots, serving platters and other transportable items.

The invented device allows a fast food server to simultaneously deliver the beverage and condiments to a waiting patron by placing the condiments and utensils in predetermined cavities and slots integrally molded with the lid of the cup. The condiments and utensils can be frictionally received by the cavities to assure proper placement until removal by the consumer.

Figure 1:
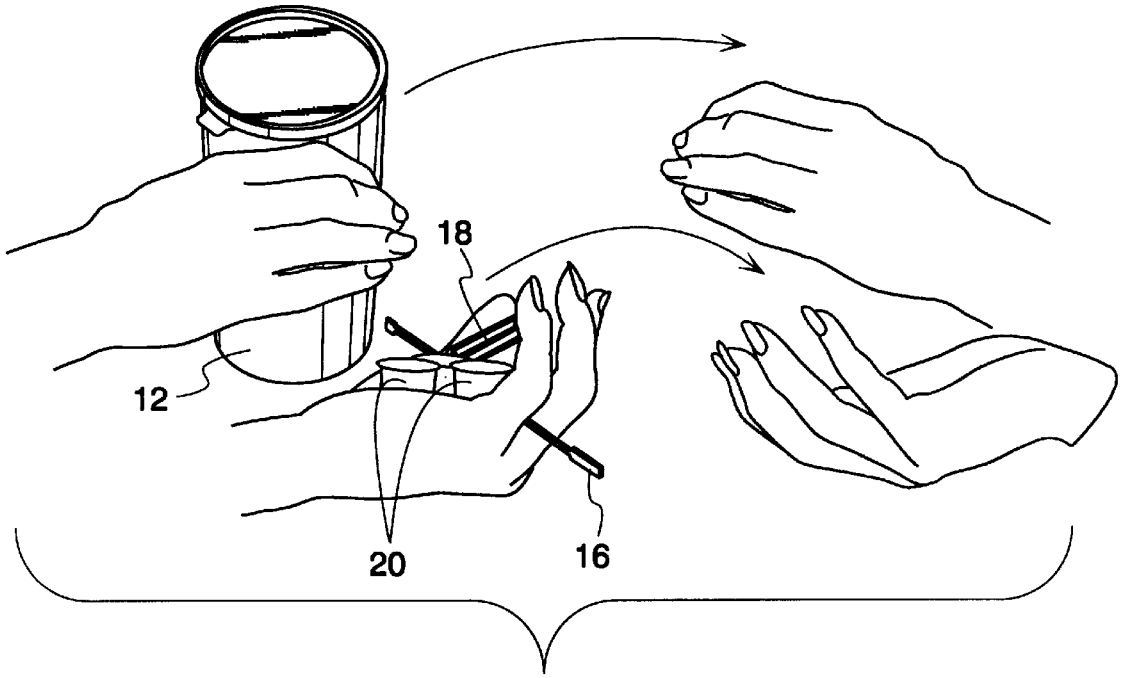
Fig. 1 PRIOR ART
FIG. 1 depicts the typical dispensing of a beverage with condiments and utensils.

The advantages of the present invention are vividly illustrated in FIG. 1 which depicts the typical exchange of beverage and condiments. As can be noted therein, the server delivers a cup 12 and lid with one hand and utensils 16 (such as stirrers or straws), packets of sweetener 18, and liquid condiment containers 20 (e.g., milk, cream, non-diary liquid) with her other hand. Concomitantly, the customer must either use both hands or multiple movements of the closest hand to retrieve the items.

Figure 2:
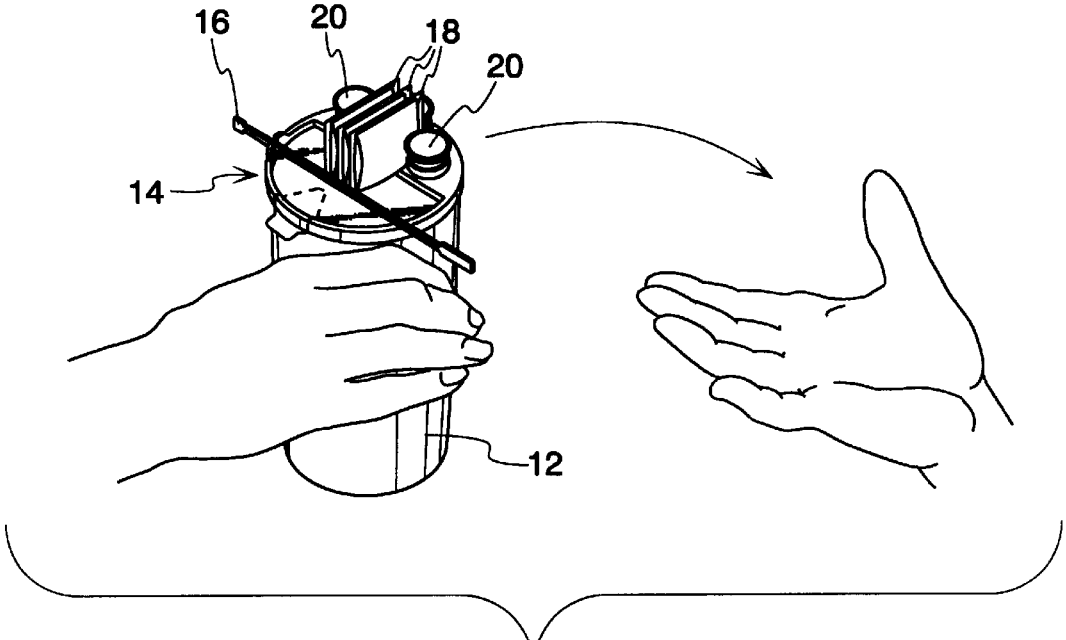
FIG. 2 illustrates the operation of the invented device, in accordance with features of the present invention.

FIG. 2 depicts the invented device in operation. As is evident from FIG. 2, one-hand, one motion activity is all that is required of the beverage vendor and the beverage recipient.

Figure 3:
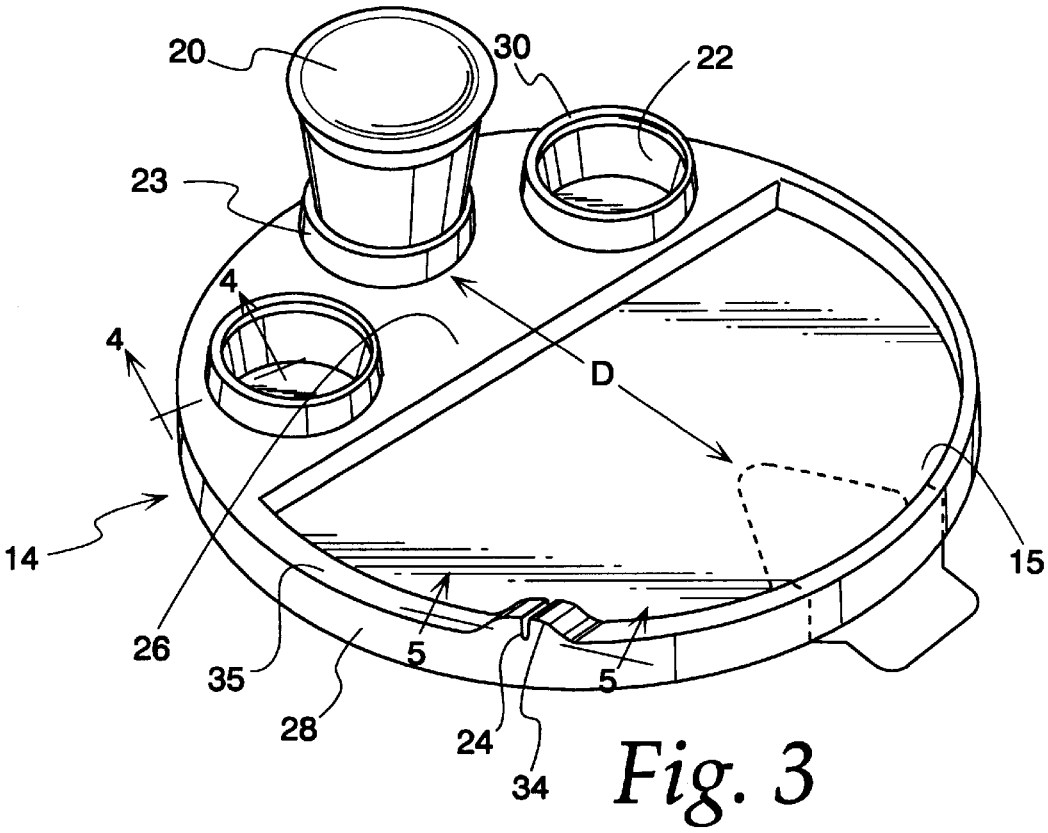
FIG. 3 is a perspective view of a first embodiment of a condiment lid in accordance with the present invention.

FIG. 3 depicts an elevated perspective view of the device without condiments and utensils loaded thereon. The cavities and slots are positioned to maintain an interlocking, compact condiment aggregate so as to prevent dislodging of the condiments from the lid during transfer or transport.

As noted supra, a lid 14 is provided with regions defining cavities 22 and slots 24 therein. As with typical beverage container lids, the lid 14 is supplied in standard diameters to accommodate standard cups used in fast-food situations and elsewhere. As such, a rim 28 of the lid is adapted to communicate with the rim of a cup having a similar diameter.

An external surface 15 of the lid 14 defines a region 26 wherein a plurality of conical-section cavities 22 are formed and adapted to receive the liquid condiment containers 20. In this embodiment, the cavities are defined by a wall 23, extending upwardly from the region 26. As such, the walls 23 are configured so as to be of a sufficient depth to prevent toppling of the condiment containers 20 from the cavities 22. Generally, the depth of the cavities are such that no displacement of beverage occurs when the lid is fully positioned on the cup. As such, the bottoms of the cavities generally are co-planar to the plane defined by the rim of the cup.

Figure 4:
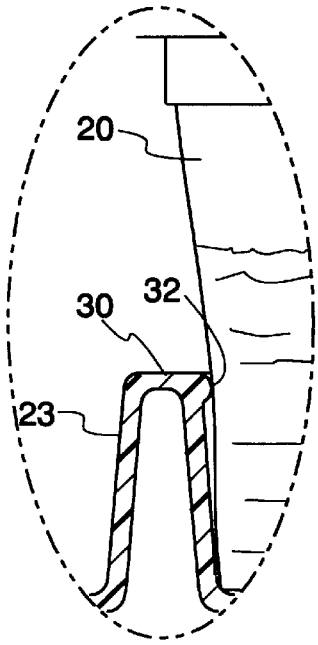
FIG. 4 is a view of FIG. 3 taken along lines 4—4.

As an optional stabilizing means, and as more clearly depicted in FIG. 4, which is a view of FIG. 3 taken along line 44, an upward extending, distal lip of each cavity forms a radial, inwardly directed protuberance 32. The protuberance 32 is adapted to frictionally communicate with the liquid condiment container 20 placed inside the cavity 22 so as to prevent the container from jostling out of the cavity.

When the cavities are loaded with the liquid condiment containers, the containers and the external surface 15 of the lid define a region in which condiment packets 18 can be partially confined when the packets are stacked with their longitudinal edges contacting the external surface. This is partially depicted in FIG. 2.

Figure 5:
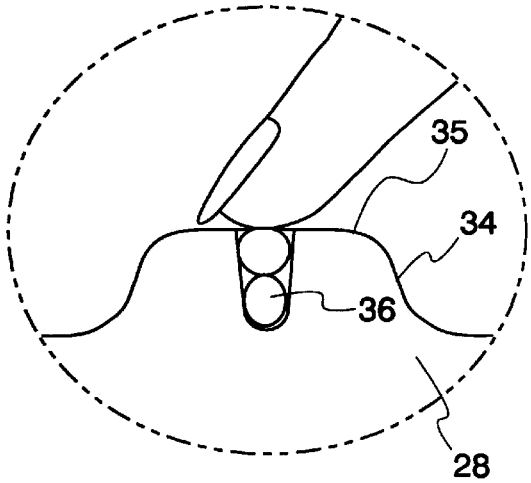
FIG. 5 is a view of FIG. 3 taken along lines 5—5.

In a region on the lid 14 extending circumferentially away from the elevated region 26, an upwardly extending periphery 34 forms a slot or plurality of slots 24. These slots are adapted to receive the utensils described earlier. FIG. 5, which is a view of FIG. 3 taken along line 5—5, depicts the slot loaded with a coffee stirrer 36. When a single slot is employed, a first end of the stirrer 36 is positioned in the slot and a second end of the stirrer is positioned so as to rest on the upper surface 35 of the upwardly extending periphery 28 of the lid 14. When two slots are employed both the first and second ends of the stirrer are positioned in the slots. In either case, the stirrer is typically positioned on the lid so as to intersect the periphery of the lid at two points reminiscent of a cord intersecting a circle.

The slot or slots also are arranged so that the longitudinal axis of the utensil inserted in the slot or slots is perpendicular to the short edge of the packets. This configuration serves to abut the short edge of the packets to the utensil and confine the packets to their consigned position. As such, the distance D between the longitudinal axis of the utensil and the cavity furthest from the axis should approximate the length of standard condiment packets. In this way, the packets will be prevented by the furthest situated liquid condiment container and the utensil from sliding longitudinally. Likewise, the packets will be prevented, by the flanking liquid condiment containers, from sliding laterally. In these position, the stirrer and condiment containers are interlocked and therefore prevented from toppling off the lid.

Figure 6:
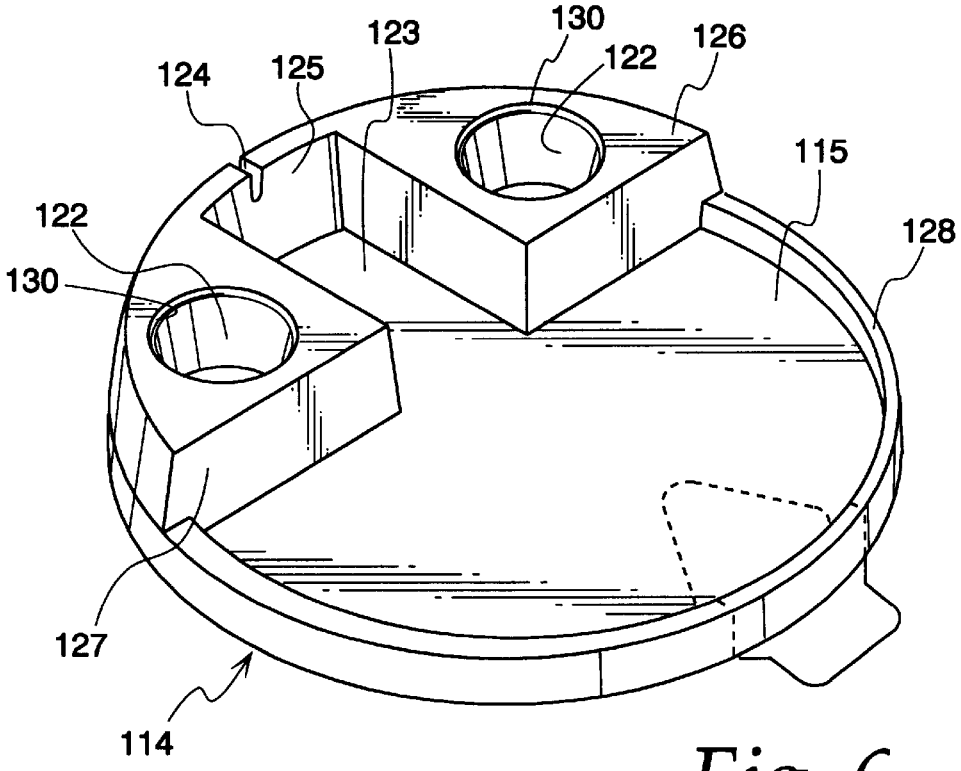
FIG. 6 is a perspective view of another beverage cup lid, in accordance with features of the present invention.
Figure 7:
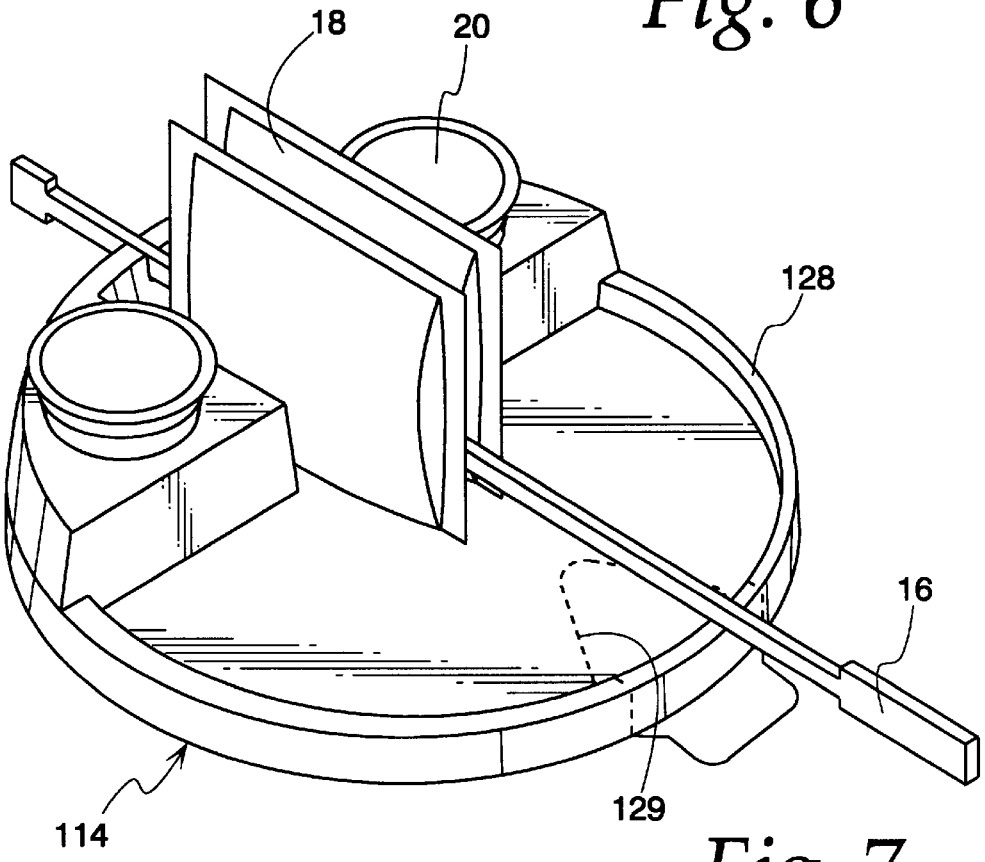
FIG. 7 is a view of the lid depicted in FIG. 6 in operation.

FIGS. 6 and 7 depict a variation of the invention described supra. In this variation, a container lid 114 defines an elevated region 126 that is generally circular in shape to coincide with the adjacent periphery of the lid but terminated on one side by an edge 127 which approximately bisects the circle formed by the periphery. This edge 127 is transverse and intersects the rim 128 of the lid at two points defining a chord on the circular rim 128. The edge is not continuous but rather defines an inlet 123 generally elongated in shape, and situated intermediate to the intersection points of the edge with the rim 128. The longitudinal axis of the inlet is perpendicular to the edge 127, and the width of the inlet is adapted to receive a plurality of condiment packets 18 arranged so that the longitudinal axes of the packets are parallel with the longitudinal axis of the inlet 123, as depicted in FIG. 7. A back wall 125 of the inlet defines a slot adapted to receive a stirrer 16 or any other similar utensil.

Due to the increased height of the elevated region 126 of the lid 114 compared to the elevated region 26 of the lid 14, the cavities 122 can be configured to be deeper than the cavities 22 depicted in FIGS. 3 and 4. Furthermore, unlike the periphery 30 of the cavities 22 of the first lid 14, the peripheries 130 of the cavities 122 are flush with the outside surface of the elevated region 126. Generally, the shape of the cavities in all embodiments can be similar to accommodate the standard-sized liquid condiment containers. This includes the provision of an inwardly directed protuberance along the periphery of the cavities to effect a friction fit with the containers. The bottoms of all cavities 122 and 123 are at least co-planar to or higher than the plane defined by the periphery of a cup to which the lid 114 attaches. This configuration prevents beverage displacement from the cup which would otherwise occur if the cavities were configured to depend into the fluid space when the lid is in place on the cup. Also, to further prevent fluid spillage, a vent hole (not shown) may be provided on the surface 126.

The rim 128 of the lid 114 also defines a slot 124 along a back wall 125 of the inlet 123. The slot 125 is adapted to receive a utensil 16 so that the longitudinal axis of the utensil is co-linear with the longitudinal axis of the inlet 123 and any packets 18 situated therein. A second slot can be formed in the rim 128 at a 180 degree position from the first slot 125 so as to more firmly place the utensil on the lid 114. However, such a second slot is not shown inasmuch as that region, which would accommodate a second slot, is presently shown defining a perforated region 129 that can be pulled off to facilitate access to the beverage without completely removing the lid.

Figure 8:
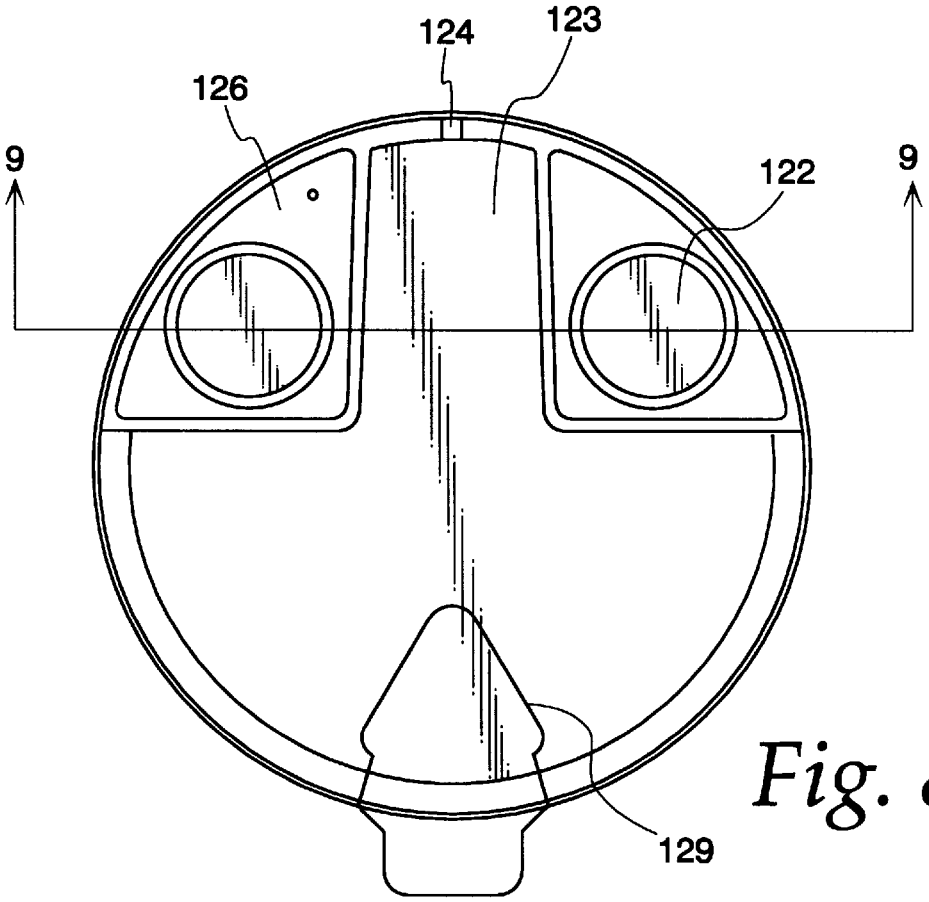
FIG. 8 is a plan view of the lid depicted in FIG. 6.
Figure 9:
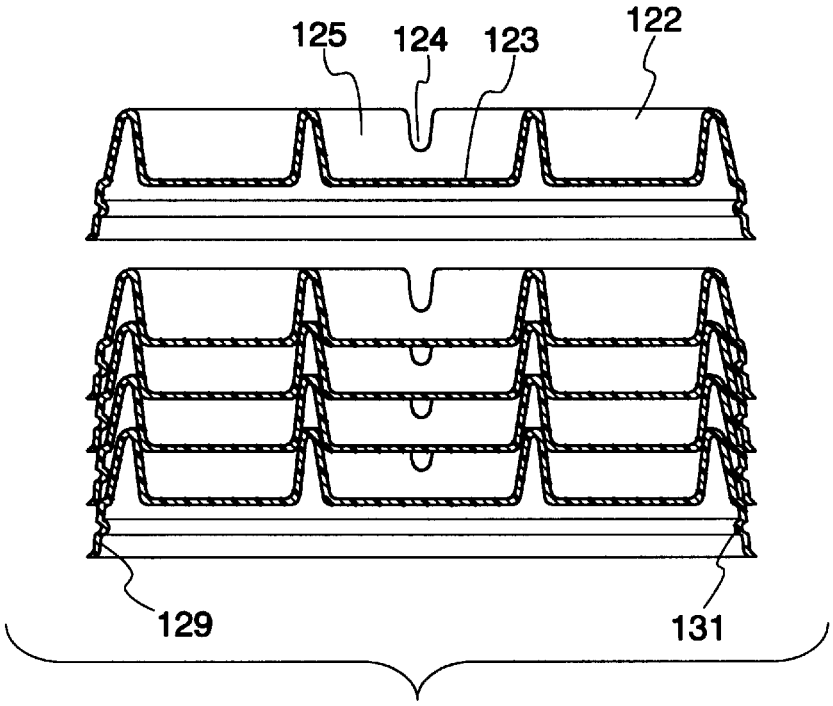
FIG. 9 is a view of FIG. 8 taken along line 9—9.

A plan view of the lid 114 depicted in FIG. 6 is FIG. 8. A view of the lid 114, taken along line 9—9 in FIG. 8 is depicted in FIG. 9. As is illustrated in FIG. 9, the lids are configured to be stacked co-planarly to form a stack. FIG. 9 also illustrates a cup rim opposing surface 129 of the lid defining an inwardly directed protuberance 131. The protuberance 131 is adapted to frictionally mate with an outer periphery of the container defining an annular groove. Aside from this friction-fit configuration, other configurations for fastening the lid to the cup can be used, for example a male-female threaded configuration, or a configuration whereby the lid is nested on the inside of the rim of the cup either frictionally or threadably.

Figure 10:
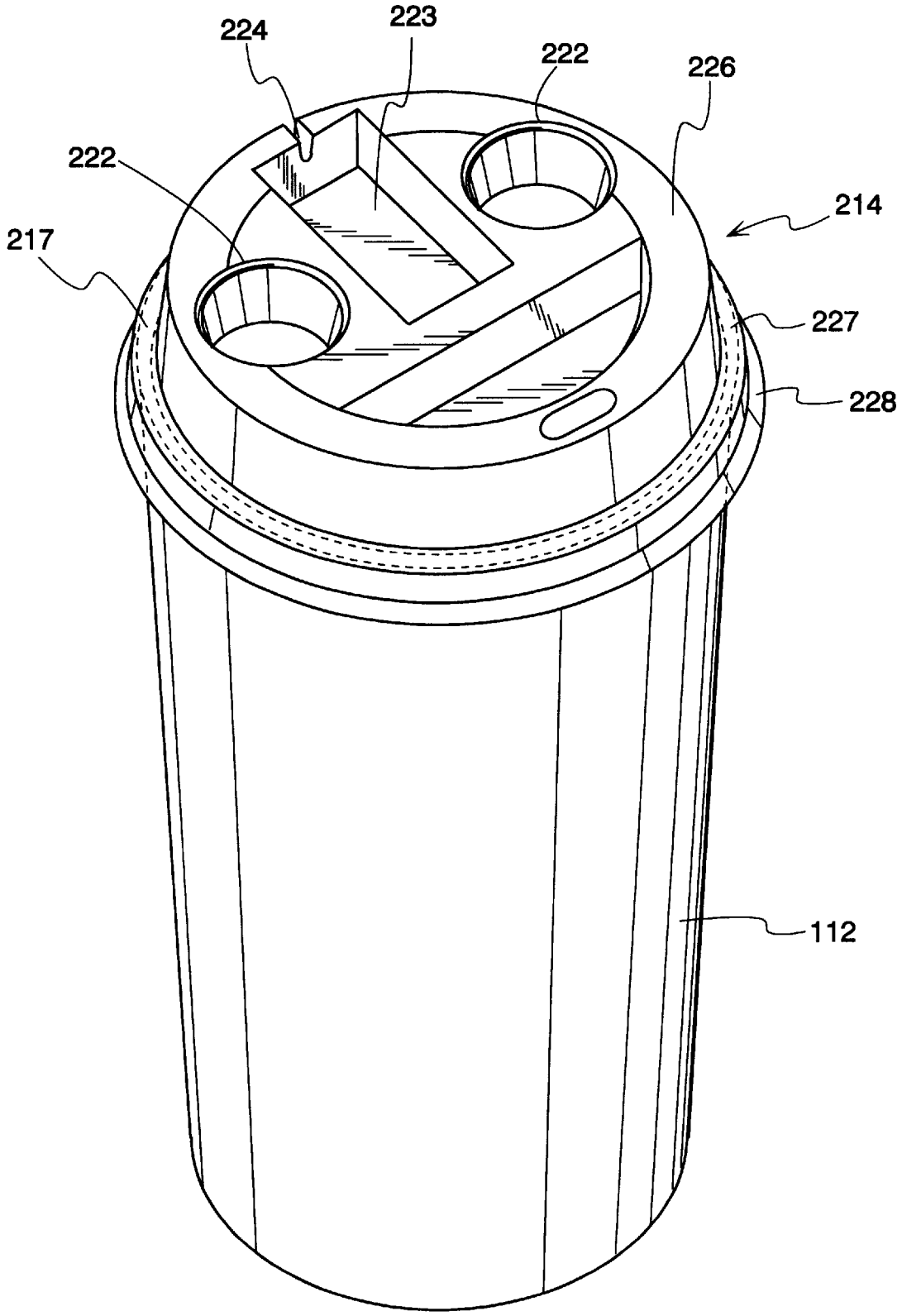
FIG. 10 is a perspective view of another beverage cup lid attached to a container, in accordance with features of the present invention.

FIG. 10 is a perspective view of another condiment-carrying lid 214 incorporating features of the present invention. The periphery 228 of the lid 214 is adapted to receive the rim 217 of a cup 112 of approximately equal diameter. The lid periphery 228 borders an elevated circular section 226. An annular shoulder 227 separates the periphery 228 from the elevated circular section 226 by radially displacing the elevated circular section inwardly.

The elevated section 226 defines two cavities 222 that are adapted to receive the liquid condiment containers 20 described supra. The elevated section also defines a generally elongated cavity 223, intermediate of the liquid condiment container cavities 222 to receive the condiment packets 18. The bottoms of all of the cavities 222 and 223 are generally parallel but superior to the plane defined by the shoulder 227. This configuration prevents liquid displacement from the cup which would otherwise occur if the cavities were configured to depend into the fluid space when the lid is in place on the cup.

The elevated section 226 also defines a radially directed slot 224 formed along a periphery 227 of the elevated section. As in the previous embodiments, the slot is adapted to receive a utensil such as a stirrer or spoon.

The exemplary embodiments of a condiment lid described supra may readily be used to cap disposable beverage cups or nondisposable cups. As such, a myriad of materials can be utilized in the construction of the lid.

The exemplary embodiments of a condiment lid presented supra may be modified in a myriad ways as can be seen by anyone with ordinary skill in the art. The stirrer-holding slit shown in each of these may be supplemented with an additional slit diametrically across the one depicted. The slits may be fashioned to hold these stirrers frictionally or a snap fit may be employed. The cavities on the top of the lid may be formed to match the shape of whatever object is stored therein and such storage may be secured by either friction, a snap fit, a helical thread, and the like. Moreover, while the exemplary embodiments illustrate circular lids appropriate for containers with circular rims, the disclosed embodiments may be modified in ways obvious to one skilled in the art to match containers or condiments of a multitude of shapes.

Lastly, cavities formed in the invented lids can be configured so that the outside, depending surfaces of the cavities extend beyond the plane defined by the rim of the container and into the container's confines. This will cause the depending cavity surfaces to become immersed in the contents of the container so as to facilitate thermal conductivity between the contents of the cavities and contents of the container. In these instances, the determination of the initial level of beverage or food will have to take into account the displacement volume of the depending surfaces of the cavities to prevent spillage.

While the invention has been described with reference to details of the illustrated exemplary embodiments, these details are not intended to limit the scope of the invention as defined in the appended claims.

The embodiment of the invention in which an exclusive property or privilege is claimed is defined as follows:

1. A device for storing condiment containers and a utensil to a container having a rim, the device comprising:

a) a generally planar substrate having a top surface and a bottom surface, said substrate adapted to be removably attached to the rim; and b) a region integrally molded with said top surface, said region adapted to removably confine the containers and utensil to said substrate by frictionally engaging said objects with said substrate, and wherein said region lies above a plane defined by the container rim, and wherein the confined utensil intersects the rim at two points.

2. The device as recited in claim 1 wherein the substrate is adapted to frictionally interact with the containers and utensil.

3. The device as recited in claim 1, wherein said lid is made of reversibly deformable material.

4. The device as recited in claim 1 wherein the container is a beverage cup and said substrate defines a plurality of cavities adapted to position a utensil, and condiment containers at predetermined locations on the substrate.

5. The device as recited in claim 4 wherein the predetermined locations facilitate contact between the condiment containers and utensil so as to secure the condiment containers and utensil to the substrate.

6. A lid for a beverage cup comprising a rim, a first region adapted to frictionally receive liquid condiment containers, a second region adapted to support non-liquid condiment containers, and a third region adapted to frictionally receive a utensil, so that the utensil intersects the rim at two points.

7. The device as recited in claim 6 wherein the regions are preconfigured to enhance contact between the containers and utensil so as to prevent spillage of the containers and utensil from the lid.

* * * * *